United States Patent [19]

Stanley

[11] 4,205,785

[45] Jun. 3, 1980

[54] WATER PLAY TOY WITH ELEVATABLE CROWN PORTION

[75] Inventor: George O. Stanley, Sunland, Calif.

[73] Assignee: Wham-O Mfg. Co., San Gabriel, Calif.

[21] Appl. No.: 836,144

[22] Filed: Sep. 23, 1977

[51] Int. Cl.[2] ..... B05B 17/08

[52] U.S. Cl. ..... 239/17; 46/41; 239/211; 239/222.17; 272/1 B; D21/173; D23/9

[58] Field of Search ..... 239/16–23, 239/211, 222.17, 381, 383, 505, 506, 222.21; 46/41, 91; 272/1 B, 27 W, 27 B; 273/95 C; D23/7, 9; D21/173

[56] References Cited

U.S. PATENT DOCUMENTS

| | | | |
|---|---|---|---|
| 755,114 | 3/1904 | Damm | 239/20 |
| 1,078,543 | 11/1913 | Hadden | 239/206 |
| 1,854,613 | 4/1932 | Ishikawa | 239/505 |
| 1,899,711 | 2/1933 | Munz | 239/506 |
| 2,241,092 | 5/1941 | Jurgilanis | 239/211 |
| 3,006,558 | 10/1961 | Jacobs | 239/222.17 |
| 3,312,400 | 4/1967 | Clearman | 239/222.21 |
| 3,481,541 | 12/1969 | Hruby, Jr. | 239/17 |
| 4,121,769 | 10/1978 | Drori | 239/222.17 |

FOREIGN PATENT DOCUMENTS

| | | | |
|---|---|---|---|
| 295,637 | 1/1954 | Switzerland | 239/222.17 |
| 197455 | 7/1967 | U.S.S.R. | 239/17 |

OTHER PUBLICATIONS

*Hellbrunn Castle Guide Book*, Fritz Czerwenka, Copyright 1974, Note p. 24.

*Primary Examiner*—Robert B. Reeves
*Assistant Examiner*—Michael J. Forman
*Attorney, Agent, or Firm*—Christie, Parker & Hale

[57] ABSTRACT

A water play toy comprising a base portion and an elevatable, elongated upper portion having a water deflector mounted at the top. A source of water under pressure is coupled to an upwardly directed nozzle located in the base portion. When the water pressure is turned on, a jet of water is directed upwardly from the nozzle through the upper portion to the deflector and the force of water lifts the upper portion into the air where it balances on the head of the water stream. When the deflector is an impeller, the upper portion rotates and an umbrella-shaped shower of water is broadcast outwardly from the deflector. As long as the water pressure is uninterrupted, the upper portion is balanced on the top of the water stream from the nozzle and continues to spray water in a circular pattern around the toy. The nozzle is slidably positionable to enable it to be positioned to direct the water stream directly vertical.

24 Claims, 13 Drawing Figures

Fig. 2
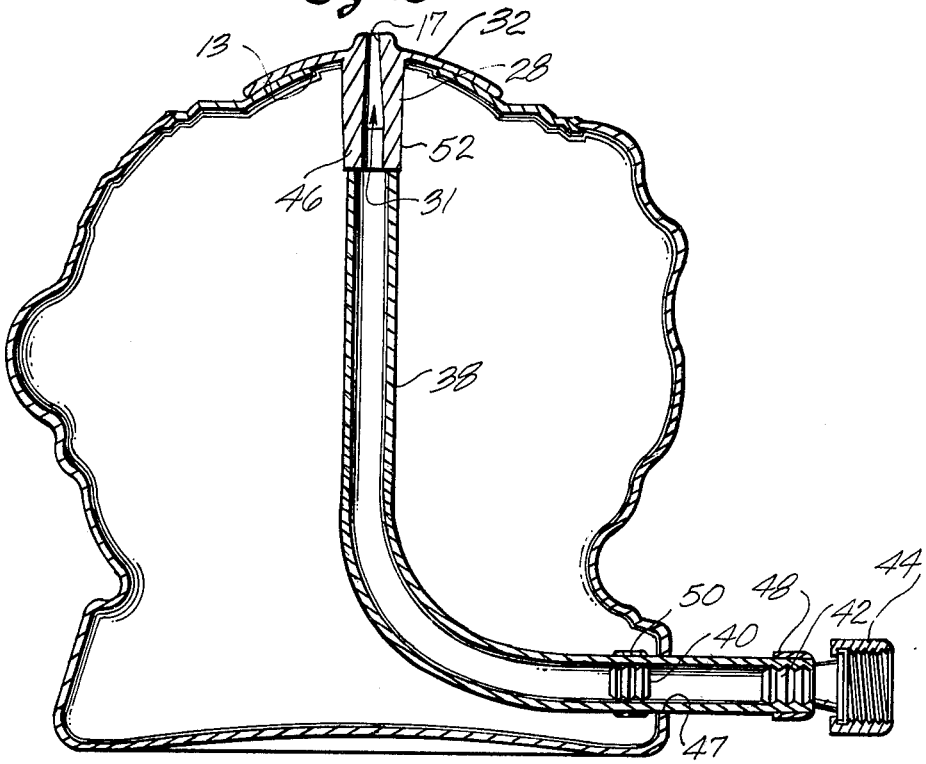
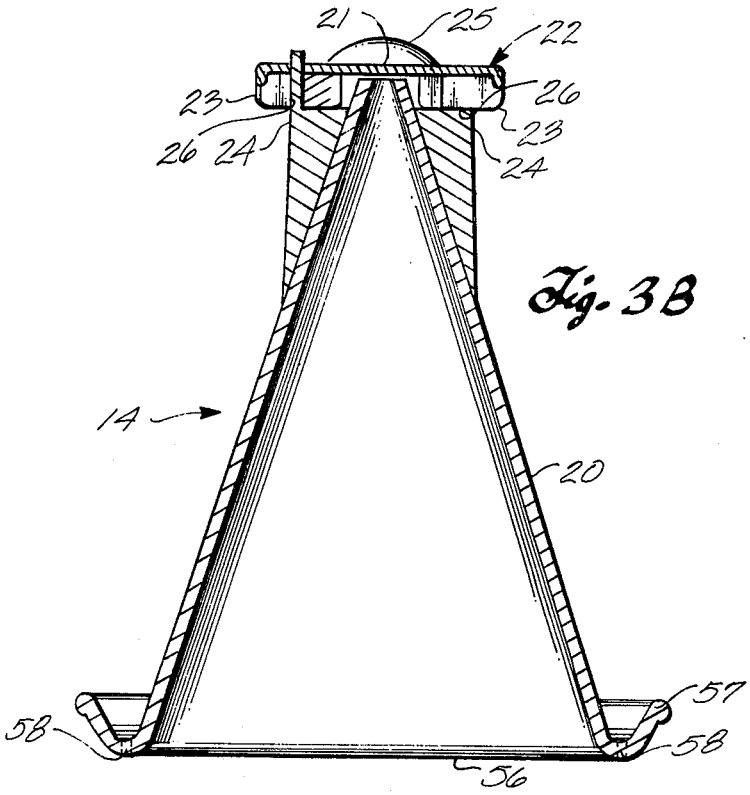
Fig. 3B

WATER PLAY TOY WITH ELEVATABLE CROWN PORTION

BACKGROUND OF THE INVENTION

The present invention relates to water play toys and decoration devices and in particular to a two-piece assembly in which a top or upper portion is removable and in operation is elevated above a bottom portion by balancing it on a stream of water.

This device according to the present invention is one which operates on the principle of balancing an object on a vertical stream of liquid, such as water. By communicating a source of water under pressure through a nozzle, a stream or jet of water is created which is directed upwardly at the bottom or underside of the object to be balanced.

The concept of elevating a body by the use of fluid pressure has been used in such applications as visual displays, lawn sprinklers and toys. Representative of the foregoing are the devices described in U.S. Pat. Nos. 1,078,432; 2,055,498; and 3,700,172.

In U.S. Pat. No. 2,055,498, spherical objects are suspended on air streams emanating from jets to simulate the suspension of bodies in a planetary or solar system. The objects to be suspended are limited to spheres which are suspended relatively short distances from the air jets. The principle of operation of such devices is one which involves the use of aerodynamic forces to cause the spheres to balance. A sphere tending to move out of the air stream is drawn back due to the difference in pressure on the high and low pressure sides of the sphere. This is what enables the operation of such a device even when a sphere is located a substantial distance away from the vertical. Such a principle is operable with gaseous fluids, but not with liquids.

In U.S. Pat. No. 1,078,432, a pop-up lawn sprinkler is shown in which an interior shaft is axially movable in a stationary outer tube connected to a water supply. The interior shaft has an axial passage of a small diameter allowing water flowing in the tube to flow through the shaft passage to an outlet where it is broadcast onto the lawn or other plantings to be watered. A broadened base at the bottom of the shaft and the relatively small axial passage react to the head of water pressure communicated through the outer tube causing the shaft to rise or "pop-up" above the ground level to more advantageously sprinkle. At the top of its rise, the broadened base of the interior shaft is held against a mating shoulder by water pressure to retain the shaft in the tube.

The principle of operation here is essentially pressure and tethering. The movable element does not balance on the head of water, but rather is forced by water pressure upwardly and is held and restrained by the retaining shoulder collar at the top of the outer tube. Thus, the interior shaft is never out of physical contact with the outer tube.

A reaction type of toy is shown in U.S. Pat. No. 3,700,172. Water communicated by a hose to a housing is conducted through a plurality of internal tubes to spray nozzles opening downwardly from the housing. The force of water emitted by the nozzles causes the housing to lift and hover over the surface on which it is placed at rest. As the term implies, the toy of the U.S. Pat. No. 3,700,172 is one which is caused to rise in reaction to the forces encountered as water passes through the outlet nozzles. Other water reaction toys are also known, including that shown in U.S. Pat. No. 3,079,727 and known as the Water Wiggle. The action/-reaction principle is also graphically illustrated by a hose having a constricted outlet which writhes like a snake when a source of water pressure is connected to the hose.

Water play toys have long been a source of great amusement and recreation value. In summer months in particular, toys which combine action and the use of water have provided diversion and a source of cooling at the same time. It has frequently been a favorite pastime of children to play using lawn sprinklers and the like by turning the sprinklers on and running through them. Even simply turning on a garden hose and squirting play companions has been popular attesting to the fascination that children have for water and water play.

The present invention belongs to this genre of toys. In addition, it combines an unusual, almost magical, visual effect which adds immeasurable to the play value of the toy. In one aspect, the present invention provides a liquid powered apparatus, including a first element for generating a jet of liquid and a second element positioned in operative relationship to the first element. Means are provided on the second element for balancing the second element on the jet of liquid.

In another aspect, the invention provides a toy having a stationary element and an elevatable hat or crown portion. A nozzle provided in the head of the stationary element directs a jet of water up through the hat portion. The reaction of the hat portion to the head of pressure generated by the water stream causes it to rise and be suspended over the stationary element. By providing the hat portion with a water deflector at the top, the toy broadcasts a circular pattern of water radially outwardly from the suspended hat.

In still another aspect, the invention contemplates a water play toy, including a source of water and means connected to the source of water for generating a relatively thin, upwardly directed, column of water. Means are positioned in operative relation to the water column generating means for being raised and balanced in the end of the column of water without additional support when water pressure is communicated from the source to the water column generating means.

In its presently preferred embodiment, the toy of the present invention is configured in the form of the head of a clown having a removable hat. Mounted at the top of the hat is an impeller. The hat is conical in shape and open at both ends so that the stream of water passing through the cone impinges upon the undersurface of the impeller which is dome-shaped in its center. The water is deflected by the dome outwardly past impeller blades or vanes extending from the undersurface of the impeller. The force of the deflected water impinging on the vanes causes the hat to rotate and to broadcast or sprinkle an umbrella-shaped shower of water in a circular pattern around the clown head.

Using normally available water pressures, the hat can be raised to a height of up to twenty feet in the air and to broadcast a circular pattern of water approximately ten feet in diameter. Increasing and decreasing the water causes the hat to rise and fall on the end of the water stream. The direction of the nozzle on the head of the clown is adjustable such that the stream of water is directed vertically upward, and when so directed, the conical hat will balance indefinitely on the end of the stream so long as it is uninterrupted.

What has been provided is a water toy which provides great fascination and entertainment value for its users by virtue of the ability to suspend an object seemingly in midair with the only means of support being a jet of water emanating from the top of the clown head. The rotating action of the impeller creates a circular water sprinkler effect, but one which is raised to a height above the heads of the users providing an elevated shower that a number of people can stand under or run through, making the toy particularly suitable for group play. Eliminating the impeller vanes produces a stationary shower. Momentary interruptions of the stream causes the hat to fall a few feet and then be caught by the stream and rise again. Turning the water off momentarily and then back on also achieves the same effect, enhancing the action of the toy and creating many "game" possibilities. When the hat is knocked off the stream or falls for other reasons, it can be placed on top of the water jet and released. That hat is immediately supported and balanced by the water stream and rises to its original height, an effect which greatly adds to the "magical levitation" effect of the toy.

In addition to play applications, the apparatus of the present invention has other contemplated applications, including but not limited to display devices and uses as decorative fountain type devices. The inherent action of the apparatus plus the use of water make the apparatus an immediate attention-getter. The adjustable height plus the shower effect make it particularly suitable for use in garden fountain settings and its effect can be further enhanced with creative use of associated lighting effects.

DESCRIPTION OF THE DRAWINGS

These and other advantages of the present invention will be better understood by reference to the drawings wherein:

FIG. 2 is a side view of the bottom portion of the invention in section;

FIG. 3B is a view taken along lines 3B—3B of FIG. 3A;

DESCRIPTION OF A SPECIFIC EMBODIMENT

Figure 1:
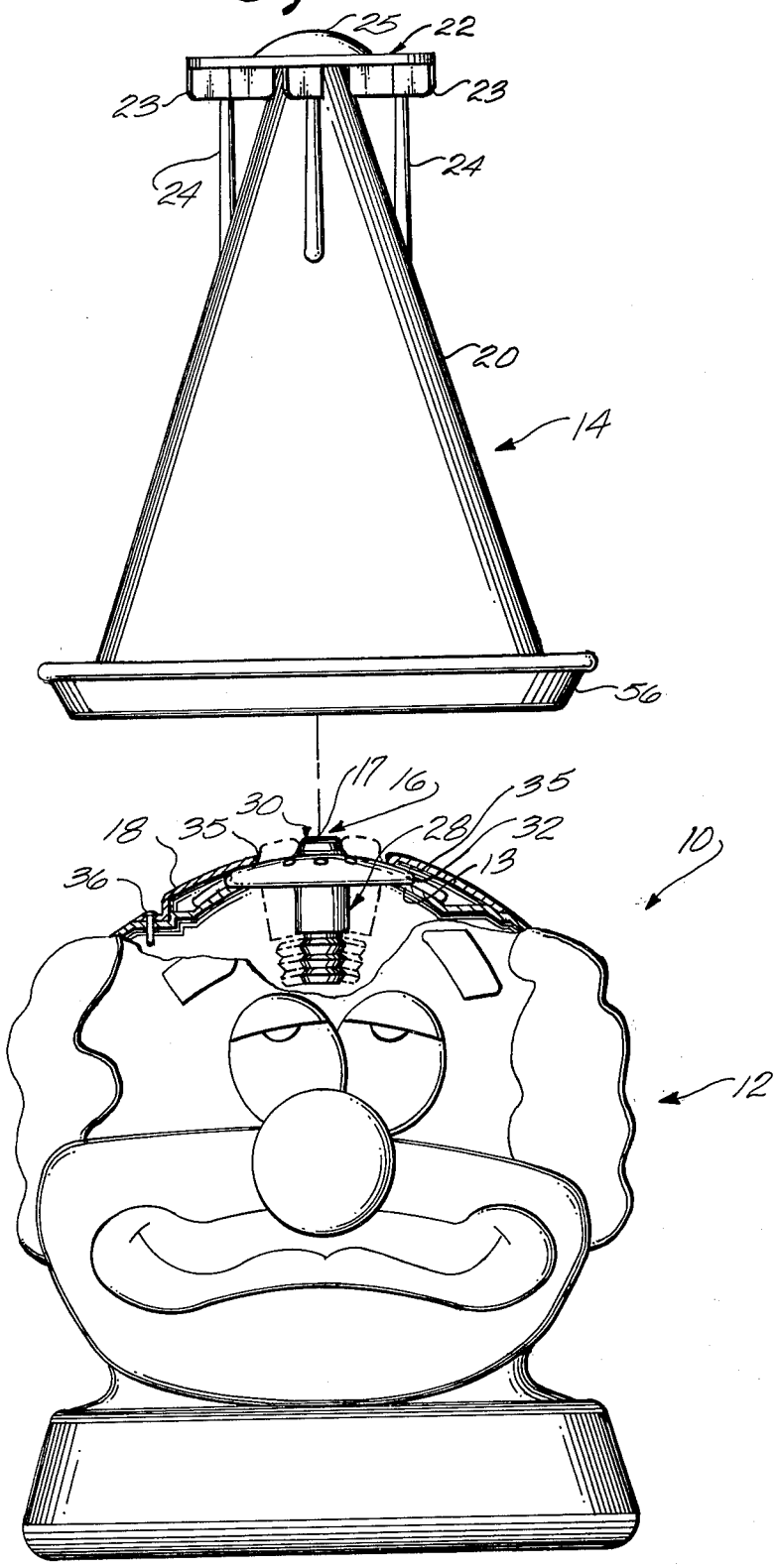
FIG. 1 is an exploded view showing the upper and lower portions of the toy according to the present invention.

An exploded front view of a water toy 10 according to the present invention is shown in FIG. 1. As shown therein, the presently preferred embodiment of the toy is in the form of a clown head 12, having a removable pointed or conically-shaped hat 14 seated on the head. Other embodiments of the invention contemplated are a spacecraft, a whale, and other figures of a head with a removable hat, such as a cowboy and a magician.

Head 12 is a plastic molded enclosure, having an opening 13 at the top for receiving a nozzle 16 and a nozzle retainer 18. As shown in FIGS. 1 and 2, nozzle 16 is umbrella-shaped and is secured in opening 13 at the top of the head by a nozzle retainer 18 having the configuration of a section of a sphere. Nozzle 16 extends from the interior through opening 13 and terminates in an outlet 17 for directing a stream or jet of water upwardly.

Figure 3A:
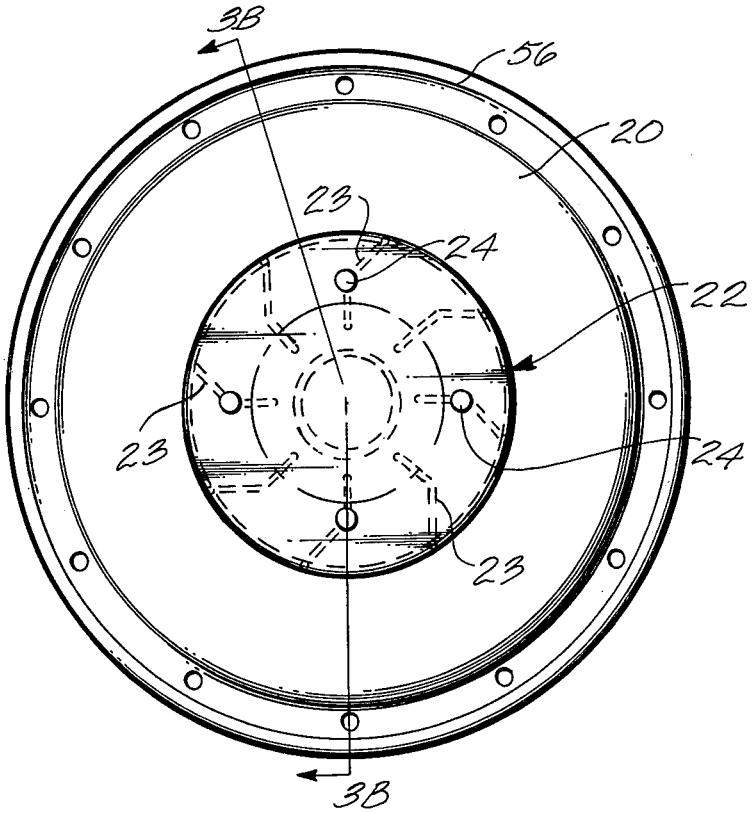
FIG. 3A is a plan view of the upper portion of the toy.

Hat 14 comprises a conically-shaped lower portion 20 and a top surface portion in the form of an impeller 22. Impeller 22 is secured to a plurality of gusseted pins 24 which are integrally formed into cone 20. Pins 24 are axially disposed around the apex of the cone-shaped bottom portion 20 as is seen from FIGS. 1, 3A and 3B. Cone 20 is open at the top and bottom with the top portion 21 of the cone being truncated to enable attachment of the impeller at the top of the cone by seating the impeller at the top of the cone such that the pins 24 pass through apertures 26 in the impeller. To secure the impeller, the pins 24 are thereafter heat staked. Impeller 22 is a disc or plate in configuration, having impeller blades 23 extending from the underside and a bubble or dome 25 formed in the center of the disc extending upwardly. Alternative embodiments of the impeller are discussed in greater detail in conjunction with FIGS. 6 and 7 of the drawing.

Figure 4B:
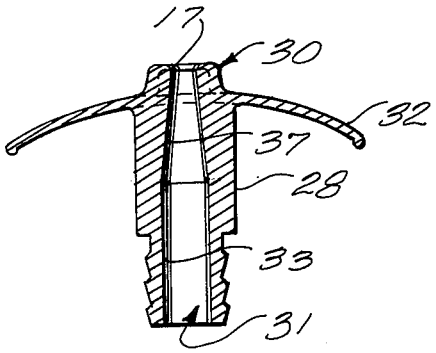
FIG. 4B is a section view of the nozzle taken along lines 4B—4B of FIG. 4A.
Figure 4A:
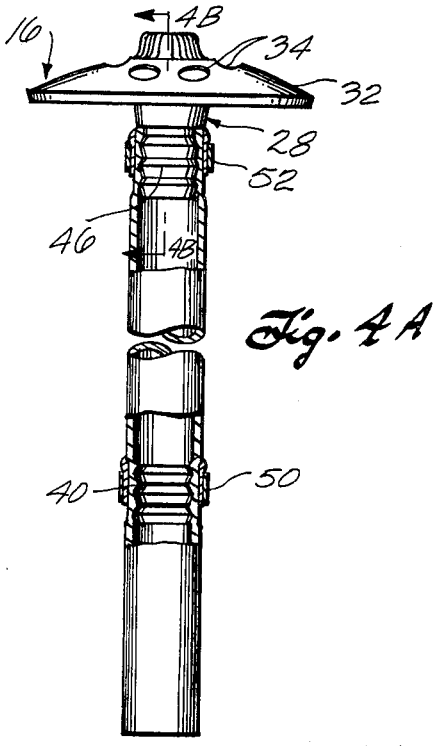
FIG. 4A is a detailed view of the nozzle assembly of the present invention.

As best illustrated in FIGS. 2, 4A and 4B, nozzle 16 comprises a central shaft or tube 28 with an axial passage 31 extending through it, a circular canopy or flange 32 integrally formed with the shaft located at the top thereof and a head 30. Canopy 32 extends generally horizontally outward from the shaft and curves downward such that the concave side faces shaft 28. Head 30 is coaxially disposed relative to shaft 28 on the side of canopy 32 opposite the shaft. Passage 31 directs a jet of water to outlet 17 and thence from the clown's head up through the hollow cone portion of the hat to impact upon the underside of the hat top portion 22.

Axial passage 31 has two cross-sectional configurations, as seen in FIG. 4B. The lower portion 33 is cylindrical and the upper portion 37 is tapered or conical to concentrate and entrain the water communicated through line 38 into a relatively thin, clean, well-defined stream or jet of water 54 which can be directed upwardly along the axis of cone 20.

The size of the canopy 32 is selected such that it has a diameter greater than aperture 13 to permit the canopy to be seated and supported by the circular periphery of aperture 13. A nozzle retainer 18 is disposed over aperture 13 and a circumferential portion of canopy 32 and is secured to the head by means of a plurality of fasteners 36. The nozzle retainer also has a central aperture 35 of a diameter selected such that it is smaller than the diameter of the canopy to overlap the circumferential portion of the canopy and hold the nozzle in a slidable relationship against the perimeter of aperture 13, permitting the nozzle to be slidably precessed through 360° about its axis. In the presently preferred embodiment, the maximum angle of variation away from the vertical axis is 10°, yielding a total angle of variation of 20°. Adjusting the angle of the nozzle enables the apparatus to compensate for being placed on a slanting or uneven surface. The nozzle is adjusted until the stream is directed vertically and falls back on itself.

As shown in FIG. 2, water is communicated to the nozzle by a length of flexible hose or water line 38. Hose 38 is preferably curved between the inlet and nozzle to reduce turbulence in the line to a minimum and prevent sputtering at the nozzle. Hose 38 is secured to the inlet to the nozzle by being friction-fitted to shaft 28 whose external surface is knurled to provide a fitting 46. A ferrule 52 clamps the hose 38 to fitting 46.

Hose 38 extends through the hollow interior of the head to an aperture 47 in the base and passes through the aperture where it is terminated in a coupling fitting 44. Coupling fitting has a knurled portion 42 which is clinched and secured to hose 38 by means of another ferrule 48. A strain relief fitting 40 is interposed in the hose immediately interiorly of aperture 47. Sudden pulls or jerks of a hose connected to fitting 44 are thereby transmitted to head 12 rather than through the hose to nozzle 16. A second ferrule 50 secures strain relief fitting 40 in place in the hose.

The rim 56 at the bottom of cone 20 is dished to provide an upwardly directed flange 57 which extends circumferentially around the base of the hat. Apertures 58 are located in the channel 59 defined by the dished rim, i.e. the side of cone 20 and flange 57, for drainage purposes. Drops of water rolling down the side of the cone drain through apertures 58 rather than having water accumulate and cause the hat to become unbalanced. A weighted bead 61 is shown in FIG. 5 at the base of cone 20 to illustrate an alternate configuration for the rim of the cone.

To enhance the stability of the object to be balanced on the stream, a cone-shaped configuration is preferred. The cone is open at its wide and narrow ends with the opening at the narrow end 21 being selected so as to comfortably pass the jet 54 of water from the nozzle. The use of a wide opening at the base and the provision of a dashed rim or weighted rim further contributes to the stability. Even under wind conditions, the hat portion follows the stream and remains balanced as the stream sways back and forth.

Figure 5:
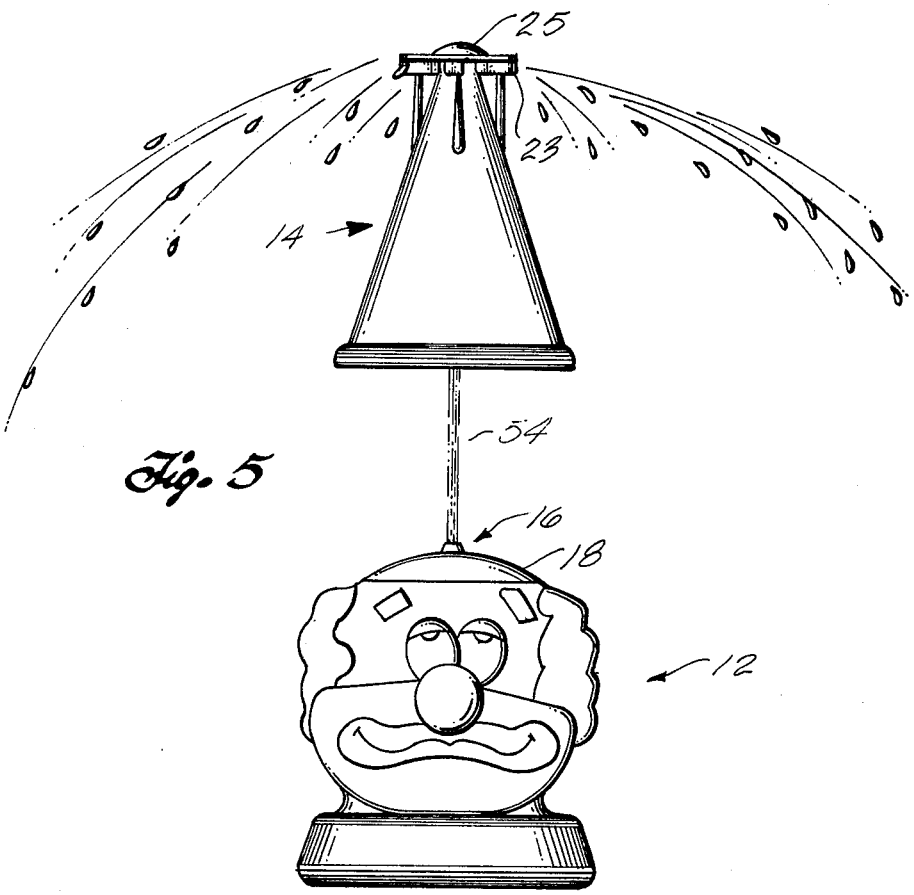
FIG. 5 is a front elevational view of the toy in operation.

The operation of the present invention is described in conjunction with FIG. 5. The toy is placed on a level surface and the hollow interior of the head is filled with water by means of apertures 34 which are spaced around the periphery of nozzle 16. The addition of water into the hollow interior of the toy gives weight and stability for proper functioning. A source of water, such as a conventional garden hose, is then connected to the coupling fitting 44.

To commence use of the toy, the water is turned on to permit a stream of water to pass through nozzle 16 to a height of twelve to fourteen inches. The stream is observed by the user and if it does not fall back on itself, the nozzle is moved within the nozzle retainer 18 until it is positioned such that the stream of water does fall back on itself.

Once the desired direction of the nozzle has been obtained, the hat portion 14 is placed on the toy and the water pressure increased to raise the hat to the desired height. This height will depend upon several factors, including the weight of the hat or crown portion, the water pressure available and the wind conditions prevailing on the particular occasion when the toy is used. The water stream 54, issuing from the nozzle, passes up through the interior of the hollow, conical portion and impacts on the undersurface of the dome 25, where it is deflected outwardly past vanes 23. As is seen in the FIGS. 3A and 3B, the vanes 23 are shaped so as to have the deflected water stream strike the angulated portions 27 of the vanes, causing the top portion to rotate in a counterclockwise direction and the water to be expelled in a canopy-shaped cascade over a circular area surrounding the water toy. Curved impeller vanes and blades can also be used in this application, the degree of angulation or curvature being directly related to the speed of rotation. Normal speeds of rotation achieved by the hat of the present invention are in the range of 30 to 60 rpm. Under normal operating conditions, the head will stay balanced and suspended on the jet of water from the nozzle indefinitely, seemingly floating on the end of the water stream and creating a shower covering a circular area having a diameter of eight to twelve feet, permitting the use of the toy as a lawn water play toy and the like.

When bumped or blown off the jet of water, the suspension of the hat on the end of the water stream can again be accompolished by merely placing the hat on the water stream without turning off the water pressure, and it will automatically rise and spin as the water impinges upon the impeller. When the use of the toy has ended, if the water pressure is cut abruptly off, the hat portion 14 will fall to the ground. When the water pressure is slowly turned off, the hat portion 14 will slowly lower and seat itself back on the head portion. The source of water is disconnected from the head 12 and the head is then inverted to drain the water within the hollow portion of the head through the apertures 34 surrounding the nozzle. The toy is then ready for storage until the next usage.

Figure 7A:
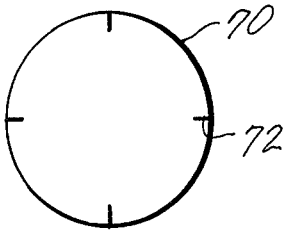
FIGS. 7A, 7B and 7C are alternate embodiments of the water deflector used with the upper portion of the toy.
Figure 7B:
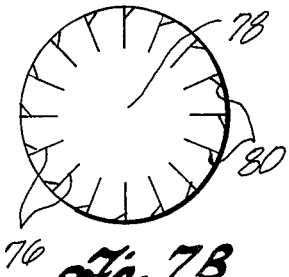
Figure 7C:
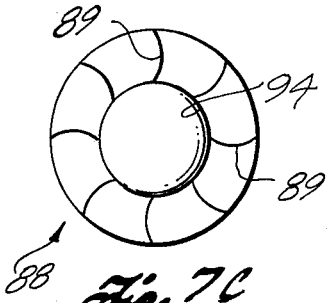

Other embodiments of the cone-impeller configuration are shown in FIGS. 6A–6C and 7A–7C. FIG. 7A is a view of the underside of the impeller used with the top portion shown in FIG. 6A. Likewise, the impeller of FIG. 7B is associated with the top portion of FIG. 6B and the impeller of FIG. 7C is associated with the top portion of FIG. 6C.

Figure 6A:
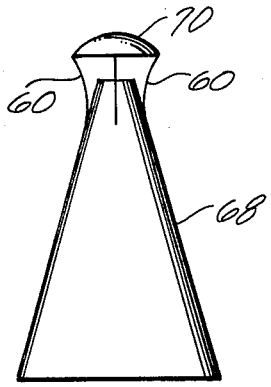
FIGS. 6A, 6B and 6C are illustrations of alternate embodiments of the upper portion of the toy.

As shown in FIGS. 6A and 7A, the top portion is conical in shape and has a dome-shaped deflecting surface 70 attached to pins 60 extending from a point adjacent the truncated apex of the conical portion. As shown in FIG. 7A, the deflecting surface 70 has no impeller blades provided on it, only the receptacles or sleeves 72 whereby the dome-shaped deflecting surface is connected to pins 60 of the conical portion 68.

Figure 6B:
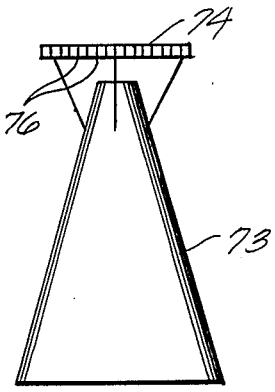

FIGS. 6B and 7B illustrate another alternate embodiment of the top portion of the toy of the present invention. In this case, a conical portion 73 is provided to which is attached an impeller 74 that is flat across the top and provided with a plurality of closely spaced blades 76, disposed around the periphery of the underside of the impeller. A water stream passing upwardly through the conically-shaped portion 73 impinges upon the impeller at approximately the center 78 of impeller 74 and is deflected outwardly in a uniform distribution passing through the spaces between the blades and impinging upon the oblique portions 80 of the blades causing the impeller to spin and produce a Rainbird type of water pattern extending radially outwardly from the impeller.

Figure 6C:
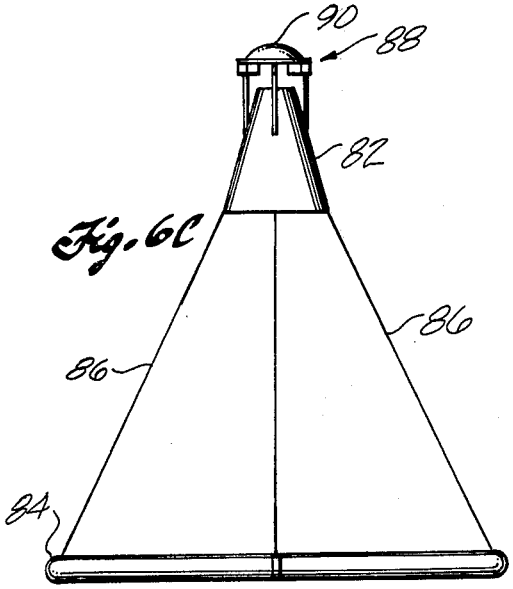

Still another embodiment of the top portion of the toy according to the present invention is shown in FIGS. 6C and 7C. In the embodiment shown therein, the bottom portion consists of a conical portion 82. A ring 84 is attached to the wide end of the conically-shaped portion 82 by means of connectors 86, such as string or other flexible filaments.

An impeller 88 comprises a centrally located dome 90 extending upwardly and vanes or blades 89 extending downwardly. Vanes 89 are arranged around the periphery of dome 90 on the underside of the impeller. A stream of water is directed upwardly through the conical portion 82, impinges upon dome 90, and is broadcast radially outwardly against the vanes to impart lifting and rotating forces to the impeller and to the conical portion connected to it. As the cone 82 rises, the connectors 86 are stretched and tensioned and in turn lift ring 84 until the entire assemblage is lifted off the ground and caused to rotate on the end of the water stream as long as the stream is left on.

What is claimed is:

1. A water play toy comprising:

a stationary base;

an elongated, hollow, open-ended, moveable crown portion seated on the base, the crown portion having a deflecting surface spaced above the end of the crown portion opposite the base;

a nozzle located at the top of the base below the crown portion;

conduit means for connecting the nozzle to a source of water; and means for directing a stream of water from the nozzle through the crown portion to the underside of the deflecting surface whereby the surface deflects the stream outwardly through the space between the deflecting surface and the crown portion to raise and suspend the crown portion solely on the stream of water.

2. A toy according to claim 1 wherein the crown portion includes stabilizing means located at the end opposite the deflecting surface.

3. A toy according to claim 2 wherein the crown portion is a truncated cone.

4. A toy according to claim 3 wherein the deflecting surface is dome-shaped with the concave surface thereof facing the nozzle.

5. A toy according to claim 4 including a plurality of impeller vanes spaced around the periphery of the deflecting surface on the concave surface thereof whereby the deflected stream of water is directed against the vanes causing the crown portion to rotate.

6. A water play toy comprising:

means adapted to be connected to a source of water for generating an upwardly directed column of water;

a housing for mounting the water column generating means;

hollow elongated support means having an opening at the bottom and top thereof adapted to be mounted on a housing over the water column generating means; and a water deflecting surface attached to and spaced above the top opening of the support means whereby water directed generally along the axis of the support means passes through the top opening, strikes the surface, and is deflected outwardly of the support means through the spacing with the force of impingement of the water causing the support means to be lifted off of the housing and balanced solely on the water column.

7. A toy according to claim 6 wherein the hollow elongated support means is a truncated cone and the water deflecting surface is a domed-shaped plate opening toward the support means mounted above and spaced away from the truncated end of the cone.

8. A toy according to claim 7 wherein the domed plate is provided with impeller blades located at spaced intervals around the dome to cause the cone to rotate while balanced on the water column.

9. A toy according to claim 8 wherein the water column generating means is a nozzle mounted in the housing with the outlet directed upwardly.

10. A toy according to claim 9 wherein the nozzle is slidably mounted in the housing for adjusting the direction of the water column emanating therefrom.

11. A toy according to claim 10 wherein the stabilizing means is an upturned rim extending around the circumference of the base, at least one aperture extending through said rim to permit drainage of water therethrough.

12. A toy according to claim 11 wherein the cone includes stabilizing means disposed around the base of the cone.

13. A toy according to claim 12 wherein the stabilizing means is an upturned rim extending around the circumference of the base.

14. A toy according to claim 12 wherein the stabilizing means is a weighted bead extending around the circumference of the base.

15. A liquid play toy comprising:

a base support element;

a hollow removable open-ended upper element seated on the base support element;

means for communicating liquid pressure to an outlet in the support element located beneath the upper element;

means located at the outlet for directing a stream of liquid through the upper element; and means located on and spaced above the upper element at the end thereof opposite the outlet for deflecting a stream of liquid outwardly through the space between said deflecting means and said upper element whereby the upper element is raised and held above the housing solely by the liquid until the liquid pressure is interrupted.

16. A toy according to claim 15 wherein the stream directing means is a nozzle communicating with the outlet.

17. A toy according to claim 16 wherein the nozzle is slidably secured in the base support element for adjusting the direction of the stream from the nozzle.

18. A toy according to claim 15 wherein the stream deflecting means is a concave surface for deflecting the liquid in an outward and downward direction.

19. A toy according to claim 15 wherein the upper element is a truncated cone having the stream deflecting means mounted above the top of the cone.

20. A toy according to claim 15 wherein the stream deflecting means is a dome having a concave surface facing the stream directing means.

21. A toy according to claim 15 wherein the stream deflecting means comprises a plurality of vanes located on the side of the deflecting means adjacent the upper element and extending radially outwardly whereby the deflected stream of liquid is directed against the vanes causing the upper element to rotate.

22. A water operated animated ornamental display apparatus comprising:

a base member in the form of a figurine or a part thereof having an upwardly facing portion incorporating a nozzle for establishing an upwardly directed jet of water; and a cooperating crown portion having a hollow interior, an open bottom shaped to seat upon the upwardly facing portion of the base member, and an open top including a jet deflector connected to and spaced above the top of the crown portion to define a space therebetween whereby when the crown portion is seated on the base member over the nozzle and water under pressure is caused to issue as a jet from the nozzle, the action of the jet entering and passing through the crown portion, striking the jet deflector, and being broadcast outwardly through said space serves to levitate the crown portion and causes it to hover in mid air over the base member without additional support.

23. An apparatus according to claim 22 wherein the base member comprises a head of the figurine and the crown portion is in the form of a hat therefore.

24. An apparatus according to claim 23 wherein the jet deflector has a plurality of vanes cooperable with the striking water jet to cause the crown portion to spin and to cause the water to spray outwardly from the top of the hovering crown portion.

* * * * *

UNITED STATES PATENT AND TRADEMARK OFFICE

CERTIFICATE OF CORRECTION

PATENT NO. : 4,205,785

DATED : June 3, 1980

INVENTOR(S) : George O. Stanley

It is certified that error appears in the above-identified patent and that said Letters Patent are hereby corrected as shown below:

Column 1, line 11, "This" should read -- The --. Column 3, line 19, "That" should read -- The --. Column 5, line 34, "dashed" should read -- dished --. Column 6, line 20, "cut abruptly" should read -- abruptly cut --.

Column 8, line 17, cancel beginning with "13. A toy according" to and including "of the base." in column 8, line 19, and insert the following claim:

-- 13. A toy according to claim 12 wherein conduit means are provided in the housing extending between the source of water and the nozzle. --

Column 8, line 34, "a" should read -- the --.

Signed and Sealed this

Seventh Day of July 1981

[SEAL]

Attest:

RENE D. TEGTMEYER

Attesting Officer

Acting Commissioner of Patents and Trademarks